US007699958B2

(12) United States Patent
Griffith et al.

(10) Patent No.: US 7,699,958 B2
(45) Date of Patent: Apr. 20, 2010

(54) METHOD FOR IMPROVING SEPARATION OF CARBOHYDRATES FROM WOOD PULPING AND WOOD OR BIOMASS HYDROLYSIS LIQUORS

(75) Inventors: William Louis Griffith, Oak Ridge, TN (US); Alicia Lucille Compere, Knoxville, TN (US); Carl Frederick Leitten, Jr., Lenoir City, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 240 days.

(21) Appl. No.: 11/563,286

(22) Filed: Nov. 27, 2006

(65) Prior Publication Data

US 2008/0121356 A1 May 29, 2008

(51) Int. Cl.
*D21C 11/00* (2006.01)

(52) U.S. Cl. ..... 162/16; 162/29; 536/56; 536/114; 536/127

(58) Field of Classification Search ..... 536/56, 536/127, 114; 106/166.01; 162/16
See application file for complete search history.

(56) References Cited

U.S. PATENT DOCUMENTS

| | | | | |
|---|---|---|---|---|
| 2,868,778 | A * | 1/1959 | Watson et al. | 536/114 |
| 3,157,594 | A | 11/1964 | Nevers et al. | |
| 3,470,148 | A | 9/1969 | Allan | |
| 3,598,730 | A | 8/1971 | Nordgren et al. | |
| 3,935,022 | A * | 1/1976 | Sihtola | 106/166.01 |
| 4,167,623 | A | 9/1979 | Fujita et al. | |
| 4,792,415 | A | 12/1988 | Colegrove | |
| 6,464,827 | B1 * | 10/2002 | Colodette | 162/63 |

FOREIGN PATENT DOCUMENTS

WO WO 02/094722 A1 * 11/2002

OTHER PUBLICATIONS

Crespo et al. "Xylitol production from waste sufite liquors", Ingenieria Quimica (Madrid, Spain), (2002), vol. 34, No. 392, pp. 136-144.

Lukanoff et al. "Characterization of hemicelluloses from spent liquors and derivatives based on them", Koksnes Kimija, (1991), vol. 4, pp. 45-47.

Samuelson et al. "Spent liquors from sodium hydroxide cooking with addition of anthraquinone", Cellulose Chemistry and Technology, (1978), vol. 12, pp. 463-472.

Area et al. "Upgrading spent liquors from NSSC process: III. Separation of spent liquors components by ultrafiltration", In Proceedings, TAPPI Pulping Conference, Orlando, FL, (Oct. 31-Nov. 4, 1999), vol. 1, pp. 237-247.

Goheen et al. "Ligin", Kirk-Othmer Encyclopedia of Chemical Technology, vol. 14, pp. 294-310.

Lin et al. "Ligin", Ullman's Encyclopedia of Industrial Chemistry, vol. 19, pp. 509-519.

* cited by examiner

*Primary Examiner*—Eric Hug
*Assistant Examiner*—Anthony J Calandra
(74) *Attorney, Agent, or Firm*—Novak Druce + Quigg LLP; Gregory A. Nelson; Gregory M. Lefkowitz

(57) ABSTRACT

A method for separating carbohydrates from pulping liquors includes the steps of providing a wood pulping or wood or biomass hydrolysis pulping liquor having lignin therein, and mixing the liquor with an acid or a gas which forms an acid upon contact with water to initiate precipitation of carbohydrate to begin formation of a precipitate. During precipitation, at least one long chain carboxylated carbohydrate and at least one cationic polymer, such as a polyamine or polyimine are added, wherein the precipitate aggregates into larger precipitate structures. Carbohydrate gel precipitates are then selectively removed from the larger precipitate structures. The method process yields both a carbohydrate precipitate and a high purity lignin.

19 Claims, No Drawings

METHOD FOR IMPROVING SEPARATION OF CARBOHYDRATES FROM WOOD PULPING AND WOOD OR BIOMASS HYDROLYSIS LIQUORS

STATEMENT REGARDING FEDERALLY SPONSORED RESEARCH OR DEVELOPMENT

The United States Government has rights in this invention pursuant to contract no. DEAC05-00OR22725 between the United States Department of Energy and UT-Battelle, LLC.

CROSS-REFERENCE TO RELATED APPLICATIONS

N/A

FIELD OF THE INVENTION

This invention relates to the field of paper production, more specifically in the treatment of spent digestion liquor resulting from the production of paper pulp.

BACKGROUND

Paper manufacture requires a source of cellulose fibers. Common raw materials as cellulose fiber sources are hardwoods and softwoods as well as those of annual vegetable origin, such as wheat and rice straw, hemp, jute, as well as annual or perennial reeds and grasses, and sugar canes which are often biennial and, in some climates, perennial. Rag materials, as well as recycled fibers, can also be used. However, wood has been, and continues to be, a primary source of cellulose fibers for paper production.

Before use, the wood or other cellulose containing raw material must be processed to release the cellulose fibers. This operation is referred to as "pulping". At present, commercial pulping operations are of three principal types: mechanical, full chemical, and semichemical. Another method of pulping, known as sulfite pulping, involves chemical transformation of the lignin component of the fiber source resulting in chemically modified lignin to be solubilized in water.

Full chemical and semichemical pulping employ chemical reagents to effect separation of the cellulosic fibers from other components. Wood chips or other raw materials are cooked with suitable chemicals in aqueous solution, usually at elevated temperatures and pressures. The object is to dissolve the organic binders holding the cellulosic fibers, termed "lignins", which vary widely but typically comprise around 20-30% of common raw woods, for example, along with other types of organic molecules, such as saccharide molecules, and other extraneous compounds, leaving the cellulose fibers intact. Although there is generally some resulting cellulose degradation, the objective can be realized to a commercially satisfactory degree through the use of a variety of chemical reagents. Pulp yields from wood using such processes usually exceed 40% of wood dry weight. The resulting liquid stream after pulping is generally referred to as wood pulping liquor, which includes lignin therein.

Lignins have been studied extensively and are believed to generally comprise the noncarbohydrate portion of the cell walls of plant materials. Originally, the lignin content of plant materials was defined as the residue after hydrolysis with strong acid following removal of waxes, tannins, and other extractives, including resins and tall oils. Lignins are amorphous, have high molecular weight, and are predominantly aromatic in structure. In general, the monomeric units comprising lignins can be referred to as p-hydroxycinnamyl alcohols. More specifically, according to *The Merck Index*, lignins comprise coniferyl, p-coumaryl, and sinapyl alcohols. Their precise composition vary with several factors including the method of isolation, and the species, age, and growing conditions, of the plant. Lignins are more or less completely removed from fiber by the digestion process of chemical pulping and enter the water phase of digestion pulping liquor in oxidized colloidal form.

Wood pulping liquors are typically concentrated by multi-effect evaporation. Concentrated pulping (black) liquors from the dominant U.S. process, Kraft pulping, are burned to provide both process energy and nearly-complete recycle of inorganic pulping chemicals. Liquors from processes, such as acid sulfite pulping, where chemical recycle is limited are marketed as concentrates. If Kraft lignin is separated, it is typically precipitated from partially concentrated hot pulping liquors. Because lignin precipitates at a pH lower than that at which hemicellulose precipitates, hemicellulose is typically coprecipitated with lignin. This may be advantageous for some applications, such as asphalt additives. However, the presence of carbohydrate increases weight loss during firing of lignins at temperatures above 200° C. A high volatiles content is not desired for applications such as carbon fiber feedstocks, in which a predominantly lignin material is fired at high temperature.

Hemicellulose is the predominant dissolved carbohydrate in wood pulping streams. A hemicellulose can be any of several heteropolymers (matrix polysaccharides) present in almost all cell walls along with cellulose. Hemicelluloses include xylan, glucuronoxylan, arabinoxylan, glucomannan, and xyloglucan. Currently, the forest products industry is funding research to evaluate methods for decreasing black liquor carbohydrates in several ways, most notably by stripping hemicellulose from wood chips by using a two-step pulping process. Hemicellulose and inorganics can also be precipitated from liquors by addition of alcohol(s) or ketones in water.

At present, the major use of hemicellulose in alkaline (Kraft and soda) pulping liquor is combustion to supply mill energy. A small amount of hardwood hemicellulose, which consists primarily of pentose (5-carbon) sugars, is currently recovered from spent sulfite pulping liquors as a feedstock for xylitol synthesis or biosynthesis. Xylitol is used as a sweetener and flavoring agent. In the sulfite pulping technologies (neutral sulfite semichemical, acid sulfite) common outside of the U.S., the need to develop uses and processing methods have resulted in the evaluation of modern separation processes for liquor components, such as lignosulfonates and hemicelluloses. These efforts often involve the use of ultrafiltration.

Several methods are known for removing carbohydrates from pulping liquors prior to lignin filtration. These methods include direct enzyme hydrolysis of hemicellulose, ion exchange stripping of hemicelluloses with acid moieties (oxidized sulfate compounds, carboxyl groups), acid hydrolysis of lignin, and selective precipitation of dissolved carbohydrates. The high hemicellulose content of commercial lignins and lignins precipitated from black liquors make direct enzyme hydrolysis of hemicellulose generally impractical, while the pH of black liquors (>pH 11) is higher than the effective pH ranges (typically pH 3 to 8.5 or, rarely, 9) of available commercial enzymes. At pH 5 to 8.5, where lignin exists as a precipitate or gel, many carbohydrate-hydrolyzing enzymes bind to lignin. The low levels of acid moieties in hemicellulose from lignin and black liquors preclude the effective use of ion exchange resin stripping. The potential for damage to the lignin structure (hydrolysis and depolymerization) by acid hydrolysis generally precludes the use of the acid hydrolysis technique.

Selective precipitation of carbohydrates dissolved in black liquors does significantly reduce volatiles in lignins produced from those black liquors. At room temperature and using either weak Kraft or alkaline pulped black liquor or commercial lignins dissolved to a similar concentration, carbohydrate precipitation could be accomplished by dropping the pH from 12 to 14 down to pH 9.5 to 10.5. However, the hemicellulose precipitates are very small, typically about 1 micron in size, and form voluminous soft gels which can be removed by centrifugation. Cleaner lignin could then be prepared by precipitation of the centrate at pHs ranging from 3.0 to 6.0. Precipitated lignin could then be redissolved and the processing steps repeated until the desired lignin (or hemicellulose) purity was obtained. This method produces high quality lignins and recovers high quality hemicellulose. However, the method is non-economical because three pH cycles were typically required.

The necessary features of black liquor processing additives for major industry generally comprise 1) little or no use of "non-process elements," (such as magnesium, iron, aluminum, nickel, or cobalt) which could cause equipment corrosion or pulp discoloration, 2) limited use of additives (not to exceed 100 to 1000 ppm each of three or fewer additives per separation), and 3) where possible, additives should be materials tested and accepted for use in paper or in foods. What is needed is an economical method to improve separation of carbohydrates from pulping and hydrolysis liquors that satisfies all the above requirements.

SUMMARY OF THE INVENTION

A method for separating carbohydrates from pulping liquors includes the steps of providing a wood pulping or wood or biomass hydrolysis pulping liquor having lignin therein, and mixing the liquor with an acid or a gas which forms an acid upon contact with water to initiate precipitation of carbohydrate and begin formation of a precipitate. During precipitation, at least one long chain carboxylated carbohydrate and at least one cationic polymer, such as a polyamine or polyimine are added, wherein the precipitate aggregates into larger precipitate structures. Carbohydrate gel precipitates are produced which are then selectively removed from the larger precipitate structures.

As noted above, the cationic polymer can comprise a polyamine or polyimine. An exemplary polyimine is polyethyleneimine. The acid forming gas can comprise carbon dioxide or sulfur dioxide. A pH of the liquor can be from 9 to 13.

The long chain carboxylated carbohydrate can be selected from carboxymethyl cellulose and salts thereof, and carboxylated or sulfated vegetable gums. Gums can be selected from the group consisting of locust bean gum, alginates, xanthan, and polybetaglucans.

The selective removing can comprise centrifugation or filtration. A concentration of the carboxylated carbohydrate and the cationic polymer after the adding step can both be less than 100 ppm. In one embodiment, the carboxylated carbohydrate is a food safe carboxylated carbohydrate. The method can further comprise the step of obtaining low-carbohydrate lignin from a filtrate after the selectively removing step. The liquor for processing can be derived from soda-anthraquinone pulping.

DETAILED DESCRIPTION OF THE INVENTION

A method for separating carbohydrates from pulping liquors comprises the steps of providing a wood pulping or wood or biomass hydrolysis pulping liquor having lignin therein. The liquor to be processed is generally basic, such as in a pH range of 9 to 13. The liquor is then mixed with an acid or a gas which forms an acid upon contact with water to initiate precipitation of carbohydrate to begin formation of a precipitate. During precipitation, at least two (2) different flocculants comprising at least one long chain carboxylated carbohydrate and at least one cationic polymer, such as a polyamine or polyimine, are added to the solution, wherein the precipitate aggregates into larger precipitate structures. Carbohydrate gel precipitates are then selectively removed from the larger precipitate structures. Concentrations of both the long chain carboxylated carbohydrate and polyamine or polyimine are generally <1 ppt, and are preferably both less than 100 ppm. The polymeric flocculants can be applied simultaneously, or more usually sequentially, or in an alternating fashion.

The acid can be sulfuric acid or a mineral acid. The gas which forms an acid upon contact with water can be carbon dioxide, sulfur dioxide, or other acidic forming gases.

As used herein the phrase "long chain carboxylated carbohydrate" refers to carboxylated carbohydrates having average molecular weights of at least 2,000, and more commonly >10,000. Carboxylated carbohydrates are generally anionic in character. Exemplary long chain carboxylated carbohydrate include carboxymethyl cellulose, and vegetable gums such as locust bean gum, alginates, xanthan, and polybetaglucans which are typically food safe, carboxylated (such as carboxymethyl or carboxyethyl) cellulose. Sodium carboxymethyl cellulose can be prepared by steeping cellulose in NaOH followed by reaction with sodium monochloroacetate, and have a high degree of polymerization.

The class of soluble anionic carbohydrates includes gums or viscosifiers. Naturally occurring gums which have anionic moieties, such as carboxylates, include certain beta glucans; alginic acids, pectins, uronic acid polymers such as gum Arabic, gum ghatti, gum karaya, gum tragacanth, and the acidic fraction of seed gums from quince, flax, psyllium, and okra, and gums produced by bacterial or fungal species during cultivation, including xanthan, gellan, welan, curdlan, rhamsan, and pullulan. Other anionic polymers which can be used with the present invention include naturally occurring sulfated carrageenans and furcellerans and fungal or bacterial phosphomannans. Chemically modified celluloses (such as carboxymethyl cellulose), anionic starches, modified dextrins and dextrans, lignosulfonates, and anionic derivatives of gums may also be used.

Conditions for dissolving or suspending these materials are well known in the art. These materials are likely to remain stable for periods of at least hours in a pH range of 9 to 11, the pH range where the flocculation step of the invention is preferably performed.

The other flocculant is generally a cationic long chain polymer. The cationic polymer can be selected from, but is not limited to, polyamines or polyimines. The polyamine or polyimine can be aromatic. Exemplary polyimines include polyethyleneimine (PEI). The average molecular weight of the cationic polymer, such as a polyamine or polyimine, is generally at least 2,000, and is more commonly >10,000.

Although generally described herein relative to polyamines or polyimines, the cationic polymer can comprise high molecular weight polymers other than polyamine or a polyimine provided they provide water solubility, and become protreated (cationic) upon contact with acid in solution.

Synthetic polyamines, polyimines, and long chain quaternary amines have traditionally used for flocculation and for surface charge modification. Exemplary generally useful specific materials which can be used for flocculation and coagulation with the present invention include poly(diallyldimethylammonium chloride), or poly-DADMAC); polyamine-poly-DADMAC blends, polyquaternary amines, PolyAPTAC, or poly(acrylamido-N-propyltrimethylammonium chloride); and PolyMAPTAC, or poly[(3-(methacryloylamino)-propyl] trimethylammonium chloride).

In some cases, the polyamine or polyimine may also be a naturally-occurring polysaccharide, such as chitin (poly N-acetyl-D-glucosamine) or chitosan (partially deacetylated chitin), which contains amine groups attached to the carbohydrate backbone. Chitin is a major constituent of insect and crustacean shells and is currently produced as a byproduct of the seafood industry. Fungal species also produce a range of aminated or amidated carbohydrates, including: chitin (many organisms), chitosan (*Mucorales*), aminopolysaccharides (for example, galactosamine, produced by *Ascomycetes* and *Hyphomycetes*). These materials are typically derived from either cell wall constituents or storage carbohydrates and often contain both anionic and cationic substituents. It is also possible to form cationic derivatives of polysaccharides and gums which function as cross-linking agents (for example, see U.S. Pat. No. 3,598,730; a xanthan gum quaternary amine; starch triazones, U.S. Pat. No. 3,157,594; lignin triazines, U.S. Pat. No. 3,470,148; or pullulan amines, U.S. Pat. No. 4,167,623; quaternary amines from xanthan, welan, and rhamsan, U.S. Pat. No. 4,792,415). It may also be possible to use cationic derivatives of long chain or cross-linked lignins (lignin-bound polyamines). Proteins which contain significant amounts of glutamine could also potentially serve as cationic crosslinkers.

As used herein polyamines or polyimines also include copolymers including monomers, including acrylamide or other non-ionic monomers. Cationizing agents can be cationic polyelectrolytes, such as polydialkyldiallylammonium salts, in particular polydialkyldiallylammonium chloride (poly-DADMAC), dicyandiamide, dicyandiamide condensate, polyamines, polyimines such as polyethyleneimine, or ionenes.

For conventional flocculation, materials of a given charge can be used interchangeably if small scale tests show that they perform the same crosslinking function. Some materials are, however, more efficient flocculants, more cost effective, or impart desirable properties to the material being removed by flocculation.

To produce optimized results, routine experimentation can be used to select a particular carboxylated carbohydrate and polyamine or polyimine specie for a particular production facility application (pulping liquor composition). One method of optimization utilizes zeta potentials to match pairs of coagulants. Zeta potential, in colloid chemistry, refers to the electrostatic potential generated by the accumulation of ions at the surface of the colloidal particle which is organized into an electrical double-layer consisting of the Stern layer and the diffuse layer. The zeta potential of a particle can be calculated if the electrophoretic mobility of the sample is known using the Henry's Equation shown below:

$$U_e = \frac{2\varepsilon\zeta f(ka)}{3\eta}$$

Where $U_e$ is the electrophoretic mobility, $\in$ is the dielectric constant of the sample, $\zeta$ is the zeta potential, f(ka) is Henry's Function (generally approximated at 1 or 1.5 using the Huckel or Smoluchowski approximation), and $\eta$ is the viscosity of the solvent.

The zeta potential of a sample of colloidal particles is quantified using an LDV, or Laser Doppler Velocimeter. The LDV applies an electrical field of known strength across the sample, through which a laser beam is then passed. The electrophoretic mobility of the colloid will dictate the velocity with which the charged particles move which will then induce a frequency shift in the incident laser beam. Using the approximation for Henry's Function, the dielectric constant of the sample, the viscosity of the solvent, and finally the measured electrophoretic mobility, the zeta potential of the particles within the colloid can be calculated.

The primary relevance of the zeta potential of a colloid is as a relative measure of the stability of that system. The DLVO theory for colloidal interactions dictates that a colloidal system will remain stable if and only if the Coloumbic repulsion arising from the net charge on the surface of the particles in a colloid is greater than the Van der Waals force between those same particles. When the reverse is true, the colloidal particles will cluster together and form flocculates and aggregates (depending on the strength of the Van der Waals attraction and the presence/absence of steric effects). Since the higher the absolute zeta potential, the stronger the Coloumbic repulsion between the particles, and therefore the lesser the impact of the Van der Waals force on the colloid.

An exemplary procedure using zeta potentials is as follows. A liquor sample is provided. A predetermined concentration of a first flocculent, such as long chain carboxylated carbohydrate is added to the sample. The second flocculent, such as PEI is added to the sample until the measured zeta potential goes to zero. Alternatively, the first and second flocculent can be added in an alternating manner. Preferred combinations of floculants provide a zero zeta potential at low concentrations of both flocculants.

It may also be possible to use flocculant pair systems modelled on those currently used to increase bonding between cellulose fibers during the manufacture of paper. These systems generally involve both a cationic and an anionic polymer which are sequentially added to cellulose fiber suspensions to create polyelectrolyte complexes which adhere to the surface of the fibers. In a similar manner, aggregation and size of hemicellulose gel particles could be increased by use of cationic+anionic polyelectrolyte complexes. Because hemicellulose and cellulose chain structures are similar, it is likely that the same paired arrangement of anionic and cationic polyelectrolytes which are used to increase cellulose interfiber bonding will increase hemicellulose gel aggregation.

After selection of the flocculant combinations, commercial application is expected to follow engineering scale-up and to use standard types of process equipment, such as the equipment described in the examples provided below.

Carbohydrate removal from pulping and hydrolyzate liquors according to the invention provides several significant advantages. Carbohydrate-stripping minimizes carbohydrate content of lignin from such liquors. This is advantageous where lignin is converted to products such as lignin chemicals, resins, or fibers. As noted above, carbohydrate-stripping lowers pulping liquor viscosity which facilitates concentration of pulping liquor by evaporation and improves mill energy balance and chemical recovery. The invention thus can materially contribute to the conservation of energy resources.

There are expected to be significant commercial applications for the invention. These include: 1) preparation of high purity lignins as feedstocks for chemicals, resins, or fibers; 2) reduction in the viscosity of pulping liquors which will increase concentration and decrease the amount of energy needed to produce pulp; 3) increased pulp mill yield and paper strength if stripped liquor is added to virgin or recycled pulp; 4) recovery of xylan for production of xylitol, solvents, and polymer intermediates; and 5) preparation of fermentable carbohydrates because precipitation according to the invention minimizes toxics found in pulping and hydrolyzate liquors.

The invention thus economically and simultaneously addresses needs in several different industrial pulping, biomass hydrolysis, and bioproduct areas. Although applicable to a broad range of liquors, the invention is expected to be particularly effective in treatment of liquors from soda-anthraquinone pulping as these have been reported to have a particularly high content of hemicellulose polymers, often attributed to protection of hemicellulose by anthraquinone.

EXAMPLES

The present invention is further illustrated by the following specific Examples, which should not be construed as limiting the scope or content of the invention in any way.

This invention was evaluated at room temperature (20-25° C.) on soda anthraquinone hardwood black liquor and on low concentration dissolved hardwood Kraft lignin. Acidification was performed using sulfuric acid. The hardwood soda liquor was from soda anthraquinone pulping of hardwood chips using approximately 10% sodium hydroxide and anthraquinone (no added sulfur).

Example 1

Hemicellulose was prepared from filtered weak black liquor by direct precipitation with diluted sulfuric acid. In a typical preparation, ~10 L of black liquor (pH of about 10.5) was placed in a 14-18 L wide mouth polyethylene bottle and stirred using a Lightnin LabMaster mixer. A 1:4 dilution of concentrated sulfuric acid was added dropwise. The pH was monitored using an Orion model 710 pH meter with a combination electrode. Trace amounts, typically 10-30 ppm of Dow Corning antifoam A (100% dimethylpolysiloxane and silica) and Dow P-4000 polypropylene glycol (polyoxypropylene, molecular weight ~4,000) were added from a dropper or a micropipette during and, if needed, after precipitation.

Two flocculants, Merck Kelco XANFLOOD® (a long chain xanthan gum which has carboxyl groups, produced by Kelco, a division of Merck & Co.), and CATIOFAST® polyethyleneimine (PEI) (provided by BASF Corporation) were each prepared as 1000 ppm clear solutions. As the pH decreased from pH 10.5 to pH 9.8 to 10 from the acid addition, 100 to 400 ml each of Xanflood and PEI solutions were slowly added. After addition of these materials was complete, the stirrer was run slowly for a minute or two, stopped, and removed from the bottle. The bottle was allowed to settle and the hemicellulose precipitate was removed by filtration using standard 0.45 to 1 micron filter bags or cartridges and refrigerated for later use. Although not used, industrially, a belt or drum filter would likely be used for precipitate removal. Low-carbohydrate lignin was obtained from the filtrate.

Example 2

Hemicellulose was obtained from dissolved (8% w/v), filtered MeadWestvaco PC 1369 hardwood Kraft lignin by direct precipitation with diluted sulfuric acid. In a typical preparation, ~10 L of dissolved lignin at pH>12 was placed in a 14-18 L wide mouth polyethylene bottle and stirred using a Lightnin LabMaster mixer. A 1:4 dilution of concentrated sulfuric acid was added dropwise. The pH was monitored using an Orion model 710 pH meter with a combination electrode. Trace amounts, typically 10-30 ppm, of antifoam were added during and, if needed, after precipitation. Two flocculants, Merck Kelco KELGIN® (a long chain alginate with carboxyl groups) and Catiofast polyethyleneimine (PEI) were each prepared as 1000 ppm clear solutions. As the pH decreased from pH 10.5 to pH 9.5 to 10, 400-800 ml each of Kelgin and PEI solutions were slowly added. After addition of these materials was complete, the stirrer was run slowly for a minute or two and stopped. The hemicellulose precipitate was removed by filtration using standard 0.45 to 1 micron filter bags or cartridges and refrigerated for later use. Low carbohydrate lignin was prepared from the filtrate.

Although the experiments were conducted at only room temperature, a range of temperatures both above and below room temperature are expected to be useful.

It is to be understood that while the invention has been described in conjunction with the preferred specific embodiments thereof, that the foregoing description as well as the examples which follow are intended to illustrate and not limit the scope of the invention. Other aspects, advantages and modifications within the scope of the invention will be apparent to those skilled in the art to which the invention pertains.

We claim:

1. A method for separating carbohydrates from pulping liquors, comprising the steps of:

providing a wood pulping or wood or biomass hydrolysis liquor having lignin therein;

mixing said liquor with an acid or a gas which forms an acid upon contact with water to initiate precipitation of carbohydrate to begin formation of a precipitate; and, during said precipitation, adding at least one long chain carboxylated carbohydrate and at least one cationic polymer, wherein said precipitate aggregates into larger precipitate structures, and selectively removing carbohydrate gel precipitates from said larger precipitate structures;

wherein said mixing step comprises adding said acid or said gas which forms an acid upon contact with water to adjust the pH of said liquor to an end range from 9.5 to 10.0.

2. The method of claim 1, wherein said cationic polymer comprises a polyamine or polyimine.

3. The method of claim 2, wherein said polyimine comprises polyethyleneimine.

4. The method of claim 1, wherein said gas comprises carbon dioxide or sulfur dioxide.

5. The method of claim 1, wherein said long chain carboxylated carbohydrate is selected from the group consisting of carboxymethyl cellulose and salts thereof, and carboxylated vegetable gums.

6. The method of claim 5, wherein said gums are selected from the group consisting of locust bean gum, alginates, xanthan, and polybetaglucans.

7. The method of claim 1, wherein said selective removing comprises centrifugation.

8. The method of claim 1, wherein said selective removing comprises filtration.

9. The method of claim 1, wherein a concentration of said carboxylated carbohydrate and said cationic polymer after said adding step are both less than 100 ppm.

10. The method of claim 1, wherein said carboxylated carbohydrate is a food safe carboxylated carbohydrate.

11. The method of claim 1, further comprising the step of obtaining low-carbohydrate lignin from a filtrate after said selectively removing step.

12. The method of claim 1, wherein said liquor is derived from soda-anthraquinone pulping.

13. A method for separating carbohydrates from pulping liquors, comprising the steps of:

providing a wood pulping or wood or biomass hydrolysis liquor having lignin therein;

mixing said liquor with an acid or a gas which forms an acid upon contact with water to initiate precipitation of carbohydrate to begin formation of a precipitate; and, during said precipitation, sequentially adding at least one long chain carboxylated carbohydrate and at least one cationic polymer, wherein said precipitate aggregates into larger precipitate structures, and selectively removing carbohydrate gel precipitates from said larger precipitate structures;

wherein said mixing step comprising adding said acid or said gas which forms an acid upon contact with water to adjust the pH of said liquor to an end range from 9.5 to 10.0.

14. The method of claim 13, wherein said cationic polymer comprises a polyamine or polyimine.

15. The method of claim 14, wherein said polyimine comprises polyethyleneimine.

16. The method of claim 13, wherein said gas comprises carbon dioxide or sulfur dioxide.

17. A method for separating carbohydrates from pulping liquors, comprising the steps of:

providing a wood pulping or wood or biomass hydrolysis liquor having lignin therein;

mixing said liquor with an acid or a gas which forms an acid upon contact with water to initiate precipitation of carbohydrate to begin formation of a precipitate; and, during said precipitation, adding at least one long chain carboxylated carbohydrate and at least one cationic polymer, wherein said precipitate aggregates into larger precipitate structures, and selectively removing carbohydrate gel precipitates from said larger precipitate structures;

wherein said mixing step comprises adding said acid or said gas which forms an acid upon contact with water to adjust the pH of said liquor to an end range from 9.0 to 10.5.

18. The method of claim 17, wherein said gums are selected from the group consisting of locust bean gum, alginates, xanthan, and polybetaglucans.

19. A method for separating carbohydrates from pulping liquors, comprising the steps of:

providing a wood pulping or wood or biomass hydrolysis liquor having lignin therein;

mixing said liquor with an acid or a gas which forms an acid upon contact with water to initiate precipitation of carbohydrate to begin formation of a precipitate; and, during said precipitation, adding at least one long chain carboxylated carbohydrate and at least one cationic polymer, wherein said precipitate aggregates into larger precipitate structures, and selectively removing carbohydrate gel precipitates from said larger precipitate structures;

wherein said mixing step comprises adding said acid or said gas which forms an acid upon contact with water to adjust the pH of said liquor to an end range from 9.0 to 10.5.

* * * * *